US006441370B1

(12) United States Patent
Khosla et al.

(10) Patent No.: US 6,441,370 B1
(45) Date of Patent: Aug. 27, 2002

(54) LINEAR MULTIPOLE ROD ASSEMBLY FOR MASS SPECTROMETERS

(75) Inventors: Mukul Khosla, San Jose; Berg Tehlirian, Daly City, both of CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 09/546,748

(22) Filed: Apr. 11, 2000

(51) Int. Cl.[7] ..... H01J 49/42

(52) U.S. Cl. ..... 250/292; 250/293; 250/290

(58) Field of Search ..... 250/292, 293, 250/396 R, 290

(56) References Cited

U.S. PATENT DOCUMENTS

| | | | | |
|---|---|---|---|---|
| 4,990,777 | A | 2/1991 | Hurst et al. | 250/292 |
| 5,373,157 | A | 12/1994 | Hiroki et al. | 250/292 |
| 5,613,294 | A | 3/1997 | Ferran | 29/825 |
| 5,852,294 | A | 12/1998 | Gulcicek et al. | 250/292 |
| 5,852,302 | A | 12/1998 | Hiraishi et al. | 250/292 |

*Primary Examiner*—Kiet T. Nguyen
(74) *Attorney, Agent, or Firm*—Dorsey & Whitney LLP

(57) ABSTRACT

A multiple-pole electrode assembly is disclosed for use in mass spectrometers or other applications such as ion traps or ion guides. The disclosed apparatus provides a rod mounting and connection assembly in which equally spaced rectangular rods are embedded in spaced, dimensionally stable insulating materials. This structure is more conveniently and inexpensively manufactured than previously available multiple pole electrode assemblies.

9 Claims, 3 Drawing Sheets

LINEAR MULTIPOLE ROD ASSEMBLY FOR MASS SPECTROMETERS

This invention relates generally to a multipole rod assembly for guiding or separating ions in a mass spectrometer assembly.

BACKGROUND OF THE INVENTION

One type of quadrupole mass spectrometer which is well known in the art employs a plurality of spaced parallel rods or elements with suitable AC and/or DC voltages applied between pairs of the rods to generate shaped electric fields in the area between the rods. A beam of charged particles to be analyzed is injected into the electric field at one end of the rods. The electric fields serve to filter the particles whereby only particles of selected mass-to-charge ratio exit from the other end. The mass-to-charge ratio of the particles which are passed is determined by the voltages applied between the rod pairs. The particles exiting the rods are detected and an output signal is generated. By scanning the voltages, the output signal represents a spectrum of the mass-to-charge ratio of the particles present in the input beam. Linear multipole rod assemblies are also used as quadrupole ion traps for Fourier transform quadrupole mass spectrometers such as described in U.S. Pat. No. 4,755,670. Linear multipole rod assemblies are also used as ion guides.

In quadrupole mass spectrometers, and in ion trap mass spectrometers, the selectivity and sensitivity of the mass spectrometer is dependent upon the accuracy of spacing of the rods in both the circumferential and radial direction along the length of the rods. In the past, rods have been supported by quartz or fused silica mounts located near each end of the rods. The quartz or fused silica mounts are machined to provide grooves which receive the rods. The rods are secured to the quartz or fused silica mounts by screws which extend through holes in the quartz or fused silica mount and into tapped holes in the rods. Machining required both for the quartz or fused silica mount and the tapped holes is relatively expensive and is critical to the proper mounting of the rods. Pairs of rods are then interconnected by metal straps or conductors.

U.S. Pat. No. 4,990,777 describes a multipole rod assembly in which the rods are supported in an aligned relationship by ceramic rings which carry metal rings with brackets supporting the rods from the ceramic rings. U.S. Pat. No. 5,852,294 describes a miniature multipole rod assembly which can be operated as an ion guide or a mass analyzer which is constructed by bonding individual rods directly to plates which are separated by ceramic insulators. The multipole rod assemblies are constructed by using a fixture which locates and orients all elements during the process or bonding the rods to the disks.

Iinear multipole rod assemblies may comprise quadrupole, hexapole and octopole assemblies. All of the prior art multipole rod assemblies are relatively expensive to manufacture with the required critical accuracy of alignment and spacing of the rods in the radial and circumferential direction.

OBJECTS AND BRIEF DESCRIPTION OF THE INVENTION

It is an object of the present invention to provide an improved multipole rod assembly for multipole mass spectrometers.

It is another object of the present invention to provide a multipole rod assembly which includes an improved rod mounting and connection assembly.

The foregoing and other objects of the present invention are achieved by a rod assembly in which rectangular rods with shaped facing surfaces are embedded in dimensionally stable supports made of insulating material.

BRIEF DESCRIPTION OF THE DRAWINGS

The foregoing and other objects of the present invention will be more clearly understood with reference to the following descriptions when read in connection with the accompanying drawings in which:

Referring to FIGS. 1–4, a quadrupole rod assembly for mass spectrometers is illustrated. The rod assembly includes equally spaced rods 11. The rods are rectangular in cross-section to form elongated rectangular rods. The facing surfaces 12 generate electric fields responsive to applied RF and DC voltages along the length of the rods for guiding or trapping ions within the volume defined by the facing surfaces 12. The facing surfaces are shown as flat; however, they may be shaped to provide desired electric fields in the space between the rod surfaces. The rectangular rods are embedded in spaced dimensionally stable insulating material supports 13 with wire bridges 14 extending between opposite or alternate rods, and also embedded in the supports 13. The rods include holes 16, FIG. 4, into which the support material flows to retain the rods in the slots 17 formed in the supports. The rods are provided with wells 18 adapted to receive wires for connecting suitable RF and DC voltages between the rods to provide suitable quadrupolar electric fields within the space between the facing edges of the rods.

In one example, the rods were held in spaced relationship in a mold with wire bridges 14 having their ends tightly inserted in wells formed in alternate rods. A suitable green ceramic material, such as Mycalex, produced by the Mykroy/Mycalex Ceramics Division of Spaulding Composites Co. was injected into the mold to embed the rods and wire bridges. The hot liquid material flowed into the holes 16 to securely retain the rods. The material was then fired, cooled and solidified. As described, the support material is selected to have good electrical characteristics, and to have a coefficient of thermal expansion which is compatible with the rods. In the one example the rods were of stainless steel. It is of course understood that other rod materials and support material may be used that have substantially identical thermal expansion characteristics.

Figure 1:
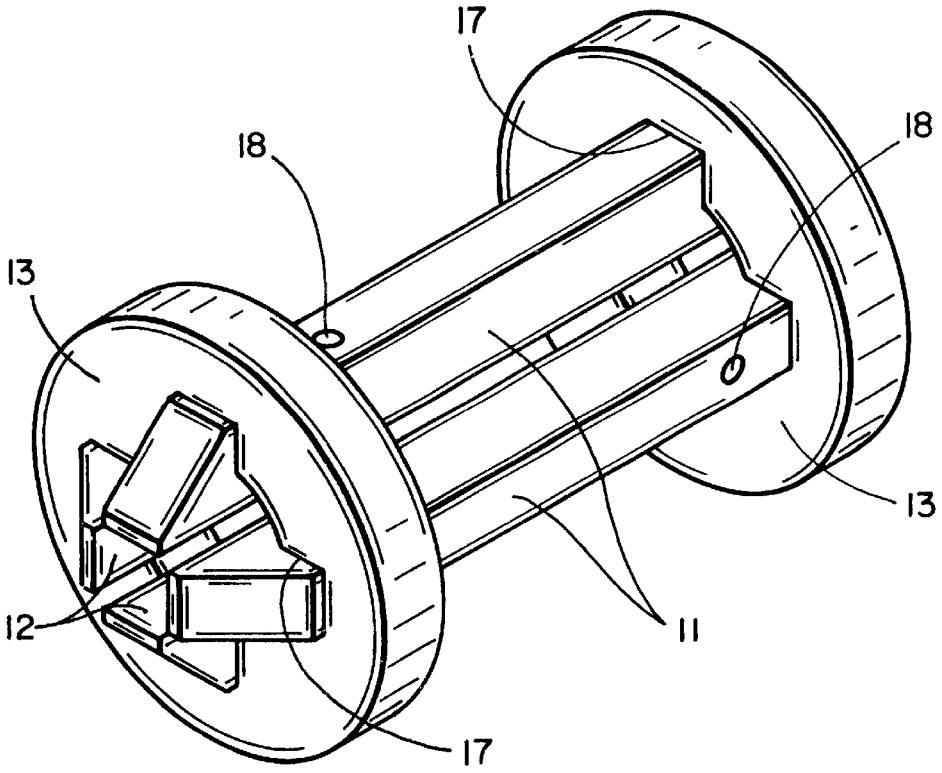
FIG. 1 is a perspective view of a linear quadrupole rod assembly in accordance with one embodiment of the invention.
Figure 3:
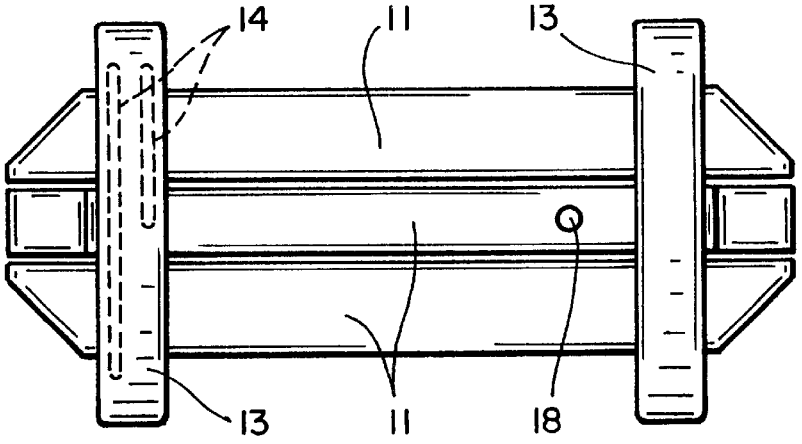
FIG. 3 is a side elevational view of the linear rod assembly of FIG. 1.
Figure 2:
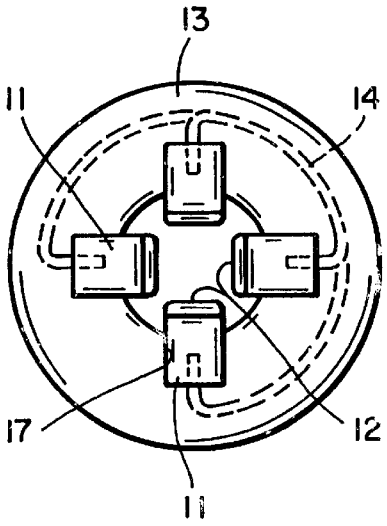
FIG. 2 is an end view of the linear rod assembly of FIG. 1.
Figure 6:
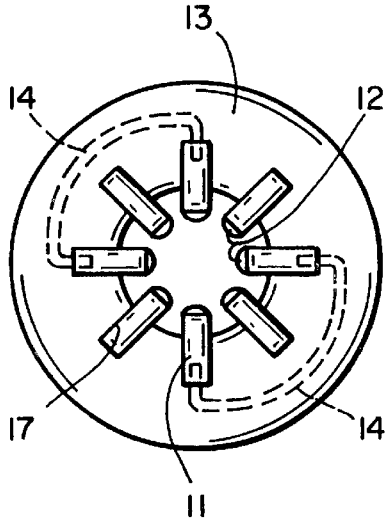
FIG. 6 is an end view of the linear rod assembly of FIG. 5.
Figure 4:
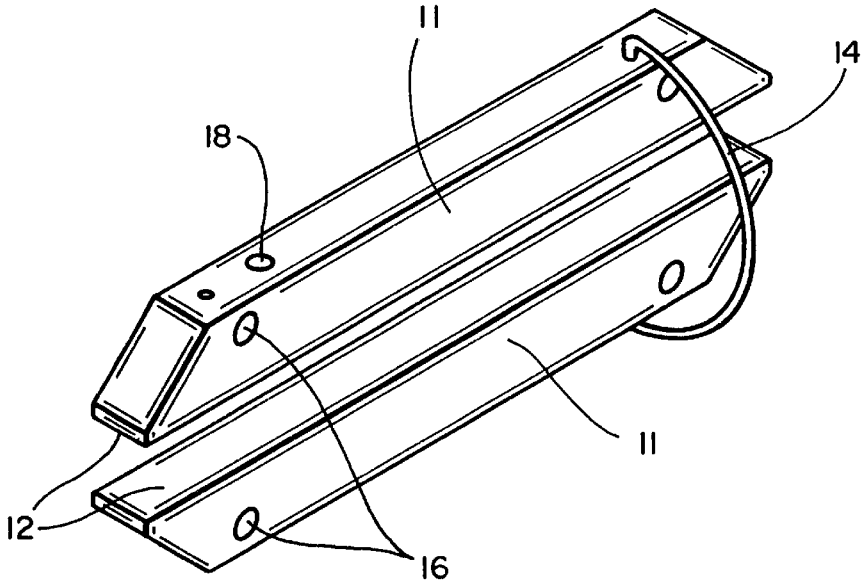
FIG. 4 is a perspective view of a pair of rods.
Figure 5:
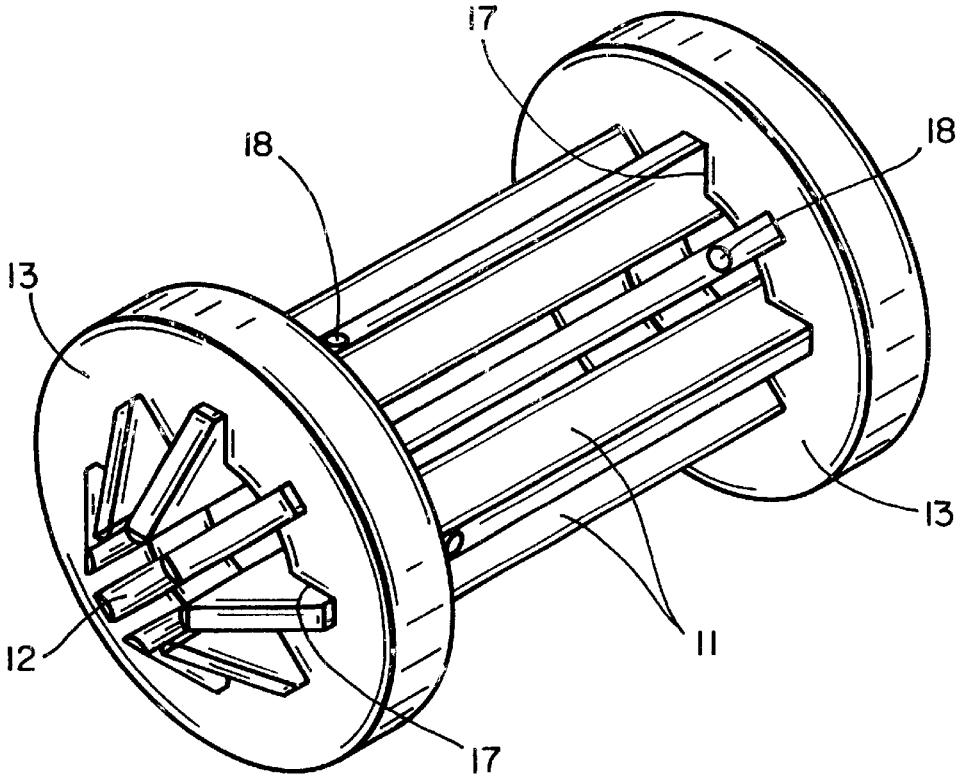
FIG. 5 is a perspective view of a linear octopole rod assembly in accordance with the present invention.
Figure 7:
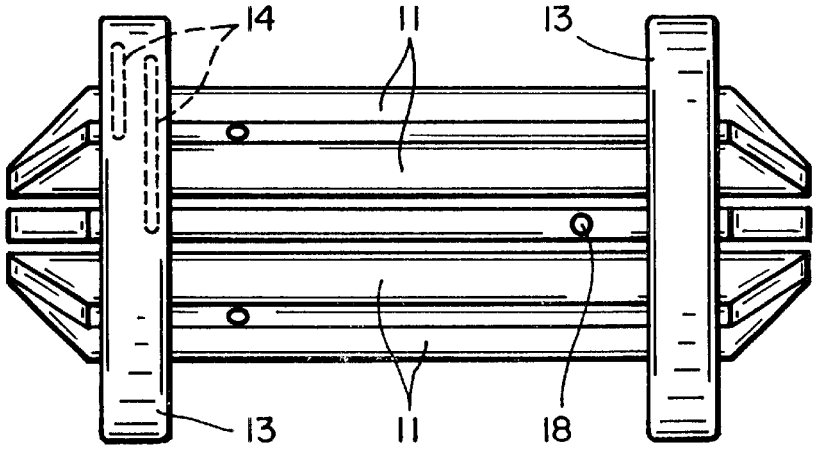
FIG. 7 is a side elevational view of the linear rod assembly of FIG. 5.

FIGS. 5–7 show an octopole rod assembly in which like parts bear the same reference numerals as those of FIGS. 1–3. The rod assembly includes rods 11 which have their facing surfaces 12 rounded to provide a desired electric field. The rods are embedded in and retained by ceramic spacers 13.

It is apparent from the foregoing that hexapole assemblies, other multipole assemblies, or bent or curved multipole assemblies, can be formed in accordance with the present invention. Thus there has been provided an easy to manufacture and assemble multipole rod assembly for use in mass spectrometry as ion guides, mass spectrometers or ion traps.

While the present invention has been described with reference to two specific embodiments, the description is illustrative of the invention and is not to be construed as limiting the invention. Various modifications may occur to those skilled in the art without departing from the true spirit and scope of the invention as defined by the appended claims.

What is claimed is:

1. A multipole rod assembly for use in mass spectrometers comprising:

a plurality of elongated rectangular aligned spaced rods having facing surfaces, and at least one molded rod support member embedding and supporting said rod assembly in spaced aligned relationship, said support member comprising an insulating material having a coefficient of thermal expansion substantially equal to that of the spaced rods.

2. A multipole rod assembly as in claim 1 in which the rods are linear.

3. A multipole rod assembly as in claim 1 in which conductive interconnect members interconnecting alternate rods are embedded in the support material.

4. A multipole rod assembly as in claim 1 in which the rods include holes into which the support material extends.

5. A multiple rod assembly as in claim 1 in which the facing surfaces are rounded.

6. A multipole rod assembly as in claim 1, 2 or 3 which includes four rods to form a quadrupole rod assembly.

7. A multipole rod assembly as in claim 1, 2 or 3 which includes rods to form an octopole rod assembly.

8. A multipole rod assembly as in claim 1, 2 or 3 which includes six rods to form a hexapole assembly.

9. A multipole rod assembly as in claim 1, 2 or 3 which includes at least two molded rod support members.

* * * * *